US011155955B2

(12) United States Patent
An et al.

(10) Patent No.: US 11,155,955 B2
(45) Date of Patent: Oct. 26, 2021

(54) DRYER

(71) Applicant: LG Electronics Inc., Seoul (KR)

(72) Inventors: Seongwoo An, Seoul (KR); Minkyu Oh, Seoul (KR); Yongnam Kim, Seoul (KR); Yanghwan No, Seoul (KR)

(73) Assignee: LG Electionics Inc., Seoul (KR)

( * ) Notice: Subject to any disclaimer, the term of this patent is extended or adjusted under 35 U.S.C. 154(b) by 188 days.

(21) Appl. No.: 16/456,627

(22) Filed: Jun. 28, 2019

(65) Prior Publication Data

US 2020/0002882 A1 Jan. 2, 2020

(30) Foreign Application Priority Data

Jun. 28, 2018 (KR) ..... 10-2018-0074575

(51) Int. Cl.
*D06F 58/24* (2006.01)

(52) U.S. Cl.
CPC ..... *D06F 58/24* (2013.01)

(58) Field of Classification Search
CPC ..... D06F 58/24; D06F 58/02; D06F 58/20
See application file for complete search history.

(56) References Cited

U.S. PATENT DOCUMENTS

2017/0051449 A1 2/2017 Nam et al.

FOREIGN PATENT DOCUMENTS

| | | | | |
|---|---|---|---|---|
| CN | 1779063 | | 5/2006 | |
| CN | 102268807 | | 12/2011 | |
| CN | 106319911 | | 1/2017 | |
| CN | 106468010 | | 3/2017 | |
| EP | 2455538 | | 5/2012 | |
| EP | 2574696 | | 4/2013 | |
| EP | 3133203 | | 2/2017 | |
| GB | 2105452 A | * | 3/1983 | ..... D06F 58/24 |

OTHER PUBLICATIONS

Extended European Search Report in European Application No. 19176775.5, dated Nov. 8, 2019, 10 pages.
Chinese Office Action in Chinese Appln. No. 201910412795.X, dated Jan. 28, 2021, 11 pages (with English translation).

* cited by examiner

*Primary Examiner* — Jessica Yuen
(74) *Attorney, Agent, or Firm* — Fish & Richardson P.C.

(57) ABSTRACT

A dryer includes a cabinet including a front panel, a door coupled to the front panel, a base disposed on a lower portion of the cabinet, a condensate water tray disposed on the base and configured to receive water, a water tank configured to be withdrawn forward of the front panel and configured to store water received in the condensate water tray, and a cap configured to couple to the water tank. The water tank includes a front surface part disposed vertically below the front panel of the cabinet, a top surface part that extends rearward from an upper portion of the front surface part and that defines a water tank inlet configured to be coupled to the cap, and a side surface part that extends rearward from each of both sides of the front surface part.

19 Claims, 20 Drawing Sheets

DRYER

CROSS-REFERENCE TO RELATED APPLICATIONS

The present application claims priority under 35 U.S.C. 119 and 35 U.S.C. 365 to Korean Patent Application No. 10-2018-0074575, filed on Jun. 28, 2018, which is hereby incorporated by reference in its entirety.

TECHNICAL FIELD

The present disclosure relates to a dryer.

BACKGROUND

Dryers are devices that can dry clothes by blowing hot air to a drum where wet clothes are accommodated. In some examples, a clothes dryer may include a cabinet in which a rotatable drum is accommodated and a door that is disposed on a front portion of the cabinet and configured to open and close the drum.

The dryer may be divided into a vented dryer and a condenser dryer according to a manner in which wet air discharged from a drum after drying clothes is treated.

In some examples of the vented dryer, air heated by a heater may be supplied into the drum to dry clothes, and wet air discharged from the drum may be exhausted to the outside of the dryer. In some cases, since moisture removed from the clothes is discharged to the outside of the dryer together with the air, a separate unit for condensing the moisture may not be required.

In some examples of the condenser dryer, air (e.g., circulation air) heated by a heater may be circulated along a circulation passage, and the circulation air may pass through the drum. In this circulation process, moisture contained in the air may be condensed or removed. The condenser dryer may be divided into a water cooling type dryer, an air cooling type dryer, and a heat pump type dryer according to a condensing manner.

In some cases of the condenser dryer, the circulation air may be condensed and result in condensate water, which may be collected in a water tank. In some examples, when an amount of water filled into the water tank is above a predetermined amount, the water tank may be emptied.

In some examples, the water tank may be separably coupled to the dryer. The user may manipulate the water tank to empty the water tank. In some examples, where the water tank is disposed in an upper portion of the dryer, the user may manipulate the water tank from the upper portion of the dryer.

In some examples, a dryer may include a control panel that controls operation of the dryer and that is installed on an upper portion of the dryer. For example, the control panel may be disposed above the door, and the water tank may be disposed behind the control panel. In some examples, the water tank may be disposed at approximately the waist height of the user. In these examples, the user may separate the water tank upward to empty the water filled in the water tank. In some cases, the user may perform a stable operation when the water tank is separated, where the water filled in the water tank may be less likely to overflow.

In some examples, a dryer may include a clothes input port and door having an increased size to improve user's convenience in the action of putting or taking out clothes into or from the drum. In these examples, the dryer may have a limited space for installing the control panel on the upper side of the door, and thus, the control panel may be disposed at a rear side of the door. In some cases, a space for installing the water tank may be limited.

SUMMARY

The present disclosure describes a dryer in which a water tank is disposed in a lower portion of a cabinet to improve a space utilization.

The present disclosure further describes a dryer in which overflowing of water from a water tank is prevented when a user manipulates the water tank.

The present disclosure further describes a dryer in which a cap is opened when water is introduced into a water tank and is closed when a user manipulates the water tank.

The present disclosure further describes a dryer in which condensate water collected below an evaporator is easily guided to a water tank in a heat pump type dryer.

According to one aspect of the subject matter described in this application, a dryer includes a cabinet including a front panel, a door coupled to the front panel, a base disposed on a lower portion of the cabinet, a condensate water tray disposed on the base and configured to receive water, a water tank configured to be withdrawn forward of the front panel and configured to store water received in the condensate water tray, and a cap configured to couple to the water tank. The water tank includes a front surface part disposed vertically below the front panel of the cabinet, a top surface part that extends rearward from an upper portion of the front surface part and that defines a water tank inlet configured to be coupled to the cap, and a side surface part that extends rearward from each of both sides of the front surface part.

Implementations according to this aspect may include one or more of the following features. For example, the dryer may further include a pump disposed at a rear side of the condensate water tray, and a condensate water tube that is connected to the pump and that extends forward toward the water tank. In some examples, the dryer may further include a water tank case that defines a front opening configured to receive the water tank therethrough, where the water tank case includes a tube coupling part that is coupled to the condensate water tube and that is disposed vertically below or above the cap.

In some implementations, the water tank may further include a handle disposed at the front surface part. In some examples, a left-right width of the front surface part may be greater than a front-rear length of the side surface part, and a vertical height of the front surface part may be less than the front-rear length of the side surface part.

In some implementations, the dryer may further include a fan configured to generate an air flow from a suction-side of the fan toward a discharge-side of the fan, an evaporator disposed at the suction-side of the fan, and a condenser disposed at an outlet-side of the evaporator facing the discharge-side of the fan. In some examples, the cap may define a water passage that is bent one or more times.

In some implementations, the cap may include a first cap member that defines a first hole configured to receive condensate water, and a second cap member disposed vertically below the first cap member, where the second cap member defines a second hole configured to discharge the condensate water into the water tank. In some examples, a center of the first hole is offset from a center of the second hole. In some examples, the first cap member may further define a recess part that is recessed downward from a top surface of the first cap member and that extends toward the first hole.

In some implementations, the cap may include a closing member that is configured to move relative to the top surface part of the water tank. In some examples, the cap may further include a cap body that has a ring shape and that defines a condensate water hole, and a fixed member that covers a first portion of the condensate water hole, where the closing member may be configured to cover a second portion of the condensate water hole and to rotate relative to the fixed member.

In some implementations, the dryer may further include a hinge protrusion that is disposed on each of both sides of the fixed member and that defines a rotational center of the closing member, and a spring coupled to the hinge protrusion and configured to provide restoring force to the closing member. In some examples, the cap may further include a cap body that has a ring shape and that defines a condensate water hole, where the closing member may include a plurality of parts each of which may have an eccentric weight distribution with a center of mass that is offset toward a side of the part.

In some implementations, the cap may further include a cap body configured to couple to the water tank inlet, the cap body defining a condensate water hole, and a moving guide that extends vertically from the cap body, where the closing member may be configured to vertically move along the moving guide. In some examples, the cap may further include a support leg that radially extends in the condensate water hole, where the moving guide may extend downward from the support leg.

In some implementations, the cap may further include a spring coupled to the moving guide and configured to provide restoring force to the closing member. In some examples, the cap may further include a stopper disposed at the moving guide and configured to limit movement of the closing member. In some examples, the stopper may disposed at a lower portion of the moving guide, where the closing member may be configured to move between the support leg and the stopper.

In some examples, the cap may include a cap body that has a ring shape and that defines a condensate water hole. The cap body may include a first cap body that extends radially outward and that is configured to couple to the top surface part of the water tank, and a second cap body that extends downward from the first cap body and that is configured to be inserted to the water tank inlet.

The details of one or more implementations are set forth in the accompanying drawings and the description below. Other features will be apparent from the description and drawings, and from the claims.

DETAILED DESCRIPTION

Hereinafter, exemplary implementations will be described with reference to the accompanying drawings. The present disclosure may, however, be implemented in many different forms and should not be construed as being limited to the implementations set forth herein; rather, that alternate implementations included in other retrogressive disclosures or falling within the spirit and scope of the present disclosure will fully convey the concept of the disclosure to those skilled in the art.

Figure 1:
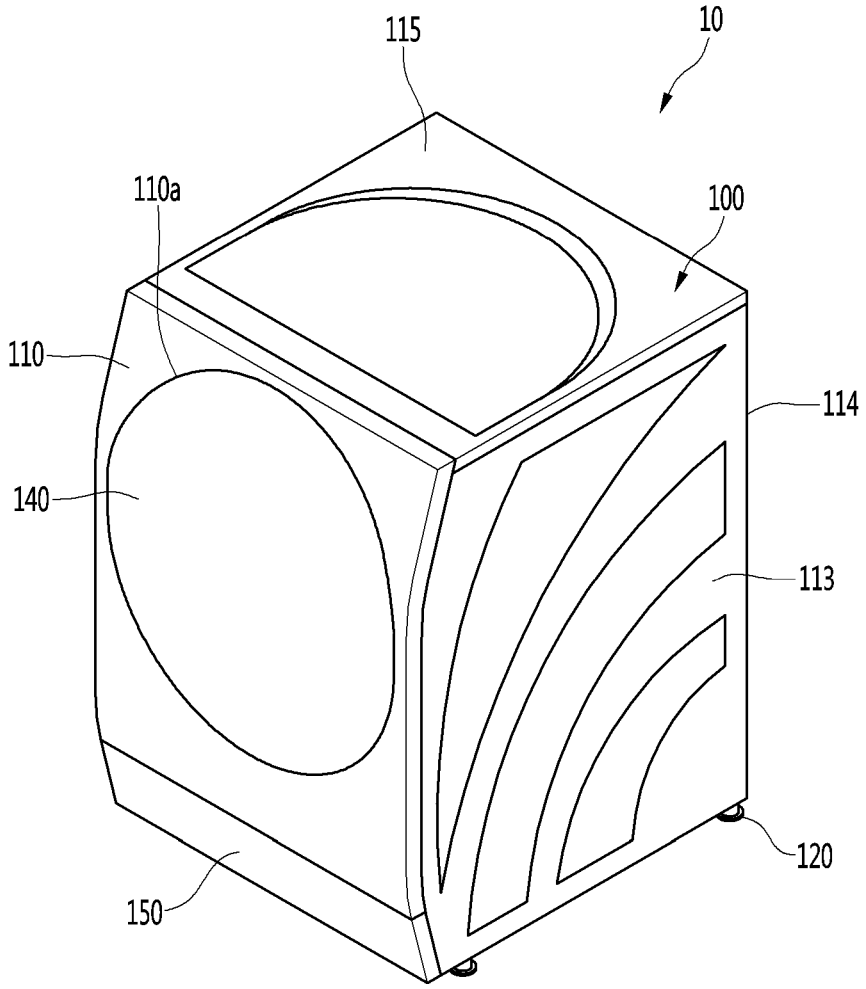
FIG. 1 is a perspective view illustrating an example dryer.
Figure 2:
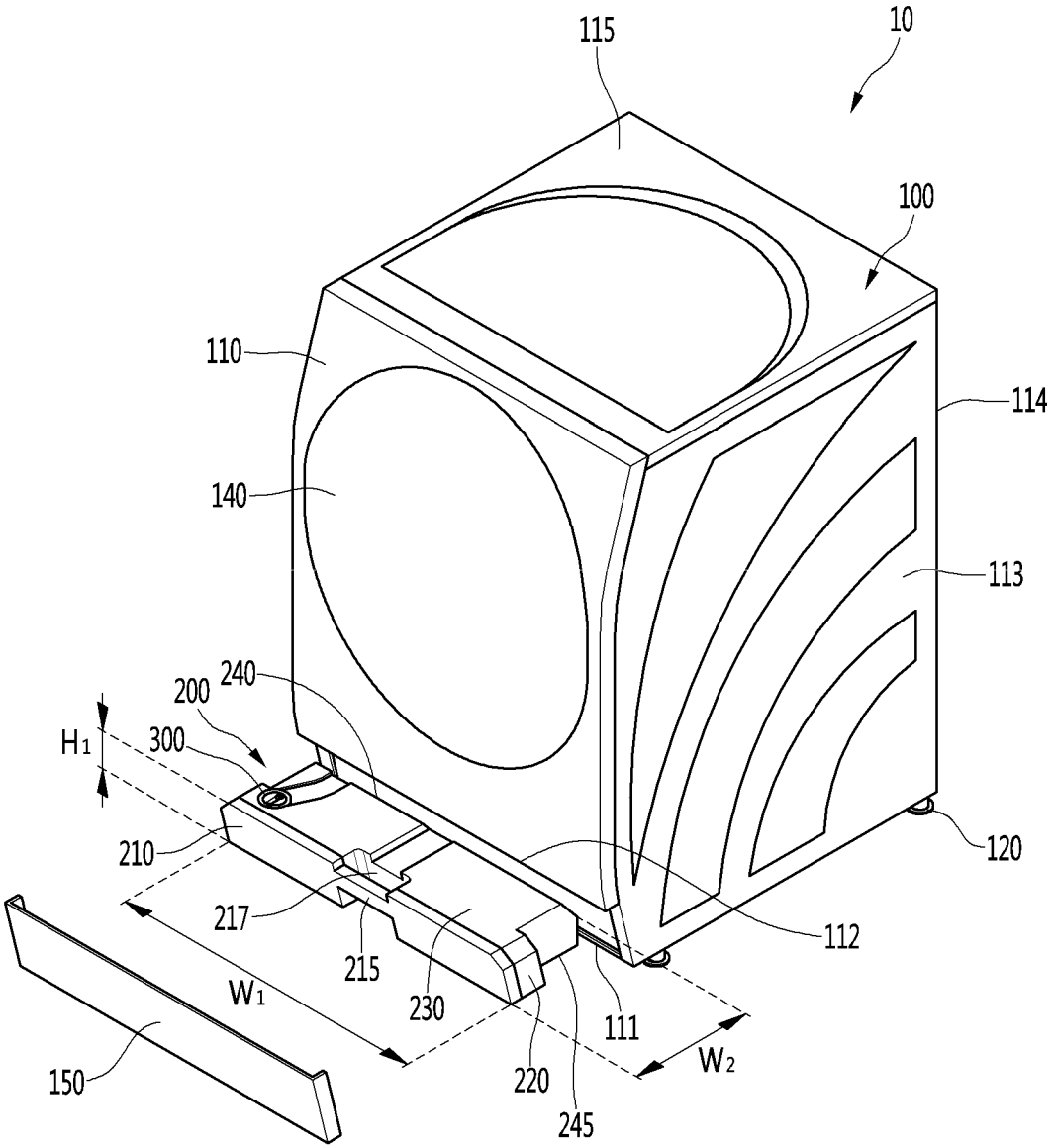
FIG. 2 is a perspective view illustrating the dryer and an example water tank that is withdrawn.
Figure 3:
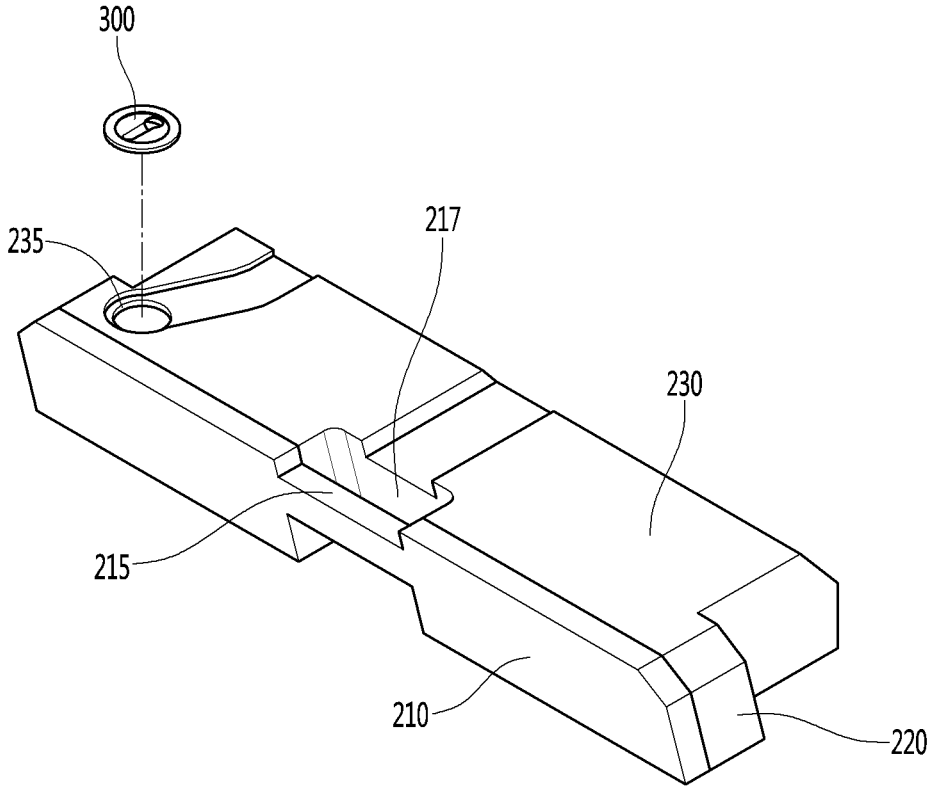
FIG. 3 is a plan view illustrating the water tank.

FIG. 1 is a perspective view illustrating an example dryer according to a first implementation, FIG. 2 is a perspective view of the dryer when a water tank is withdrawn according to the first implementation, and FIG. 3 is a plan view illustrating an example configuration of the water tank according to the first implementation.

Referring to FIGS. 1 and 2, a dryer 10 according to a first implementation includes a cabinet 100 defining an outer appearance thereof. The cabinet 100 may have an approximately rectangular parallelepiped shape, and may include a plurality of panels. For example, each of the plurality of panels may have a rectangular plate shape.

In some implementations, the plurality of panels may include a base panel 111 defining an outer appearance of a lower portion of the cabinet 100, a front panel 110 extending from a front portion of the base panel 111 upward, and a side panel 113 extending upward from each of both sides of the base panel 111. Each of both the side panels 113 may extend backward from each of both sides of the front panel 110.

The plurality of panels may further include a top panel 115 disposed on both the side panels 113 and a back panel 114 disposed on rear sides of both the side panels 113.

The plurality of panels may define a space in which a rotatable drum is installed. The drum may define a clothes treatment space therein in which clothes are dried.

In some implementations, the front panel 110 defines an input port 110*a* for putting the clothes into the drum. For example, the input port 110*a* may have a circular shape and be disposed at a central portion of the front panel 110.

The dryer 10 may further include a door 20 that is configured to open and close the input port 110*a*. In some examples, the door 20 may have a circular shape corresponding to the shape of the input port 110*a*.

The door 140 may be disposed on a front side of the front panel 110 and rotatably coupled to the front panel 110. The hinge device may be provided at a side portion of the input port 110*a*.

In some implementations, a control panel may be disposed in the door 140. The control panel may include a display (for example, an LCD, an LED panel, and the like) displaying an operation state of the clothes dryer and an input unit (for example, a button, a dial, a touch screen, and the like) receiving an operation command of the clothes dryer from a user. For example, the control panel may be disposed on an upper portion of the door 140.

The dryer 10 further includes a mount supporting the cabinet 100. The mount 120 may be coupled to a lower portion of the cabinet 100 and placed on the ground. The mount 120 may absorb vibration generated in the dryer 10 to transmit the vibration to the ground.

The dryer 10 further include a cover 150 that is separably coupled to a lower portion of the front panel 110. The cover 150 may be coupled to a front opening 112 of the cabinet 100 to cover the front opening 112. The front opening 112 may be defined in the lower portion of the cabinet 100. Thus, the front opening 112 may be understood as an opened portion between the front panel 110 and the base panel 111. A vertical height of the front opening 112 may be understood as a value obtained by subtracting a vertical height of the front panel 110 from a vertical height of the side panel 113.

A water tank 200 that is detachably disposed on the cabinet 100 may be disposed at a rear side of the cover 150. That is, the water tank 200 may be inserted backward through the front opening 112. The user may separate the cover 150 to expose the water tank 200 to the outside so as to separate the water tank 200 from the cabinet 100. The water tank 200 may be withdrawn to a front side of the front opening 112.

Referring to FIGS. 2 and 3, the water tank 200 may have a flat case shape that is enough to be inserted into the front opening 112. For example, a left-right width w1 of a front surface part 210 of the water tank 200 may be greater than a height H1 of the front surface part 210 of the water tank 200, and a front-rear length w2 of a side surface part 220 may be greater than a height H1 of the front surface part 210. Also, the left-right width w1 may be greater than the front-rear length w2.

In detail, the water tank 200 includes a front surface part 210 covered by the cover 150, a side surface part 220 extending backward from each of both sides of the front surface part 210, a top surface part 230 connecting upper portions of both the side surface parts 220, and a rear surface part 240 extending vertically from a rear portion of the top surface part 230. Also, the water tank 200 further include a bottom surface part 245 supported on the base panel 111.

A storage space in which condensate water (water) is stored may be defined in the water tank 200 by the front surface part 210, both the side surface parts 220, the top surface part 230, the rear surface part 240, and the bottom surface part 245.

A water tank inflow part 235 through which the condensate water generated in the dryer 10 is introduced may be disposed in the top surface part of the water tank 200, and a cap 300 may be disposed on the water tank inflow part 235. The cap 300 may be separably coupled to the water tank inflow part 235, and the user may separate the cap 300 from the water tank inflow part 235 to empty the water tank 200. A method in which the cap 300 is coupled to the water tank inflow part 235 is not limited to a specific implementation. For example, the cap 300 may be coupled to the water tank inflow part 235 through a rotational manner or may be coupled to the water tank inflow part 235 through a hook coupling or fitting coupling manner.

A handle 215 grasped by the user is disposed on the front surface part 210 of the water tank 200. Also, a handle hole 217 is defined in a rear portion of the handle 215. The user may be put into the handle hole 217 to pull the handle 215, thereby taking out the water tank 200 from the cabinet 100.

Figure 4:
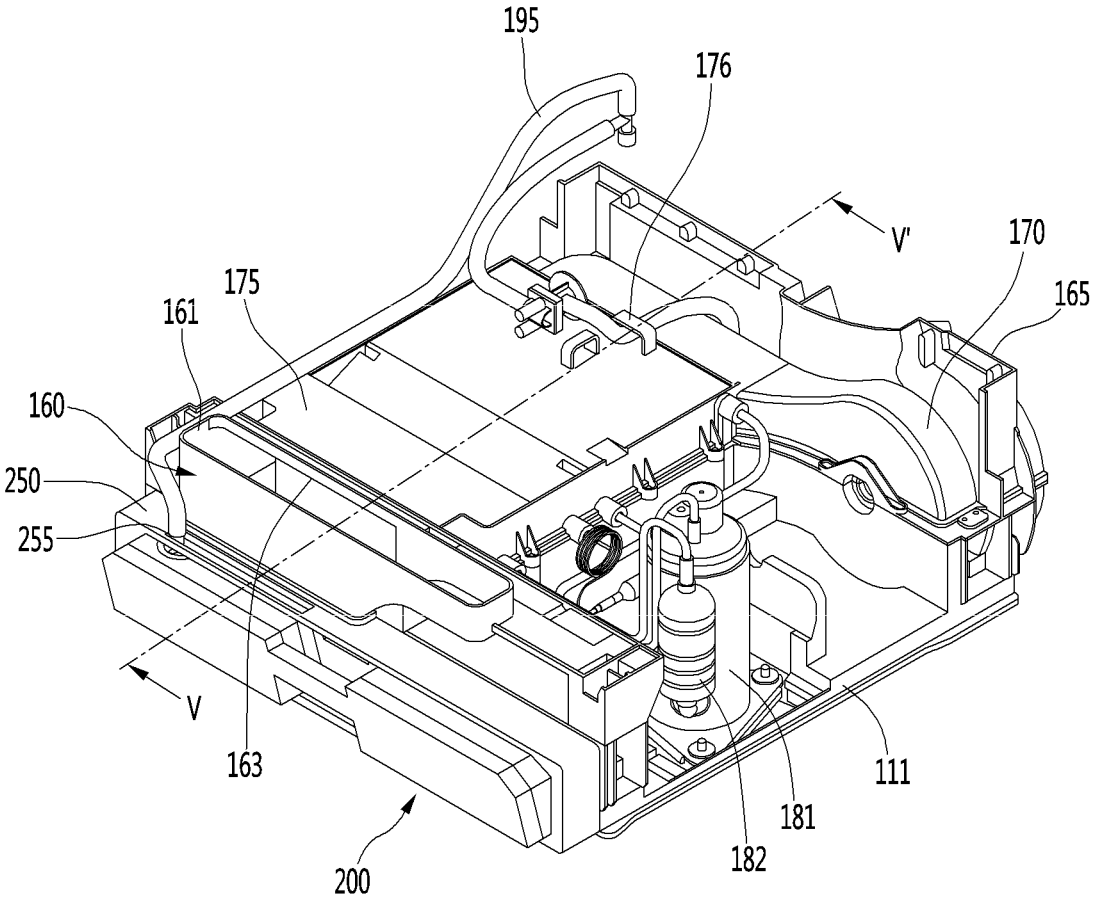
FIG. 4 is a view illustrating example components disposed in a lower portion of the dryer.
Figure 5:
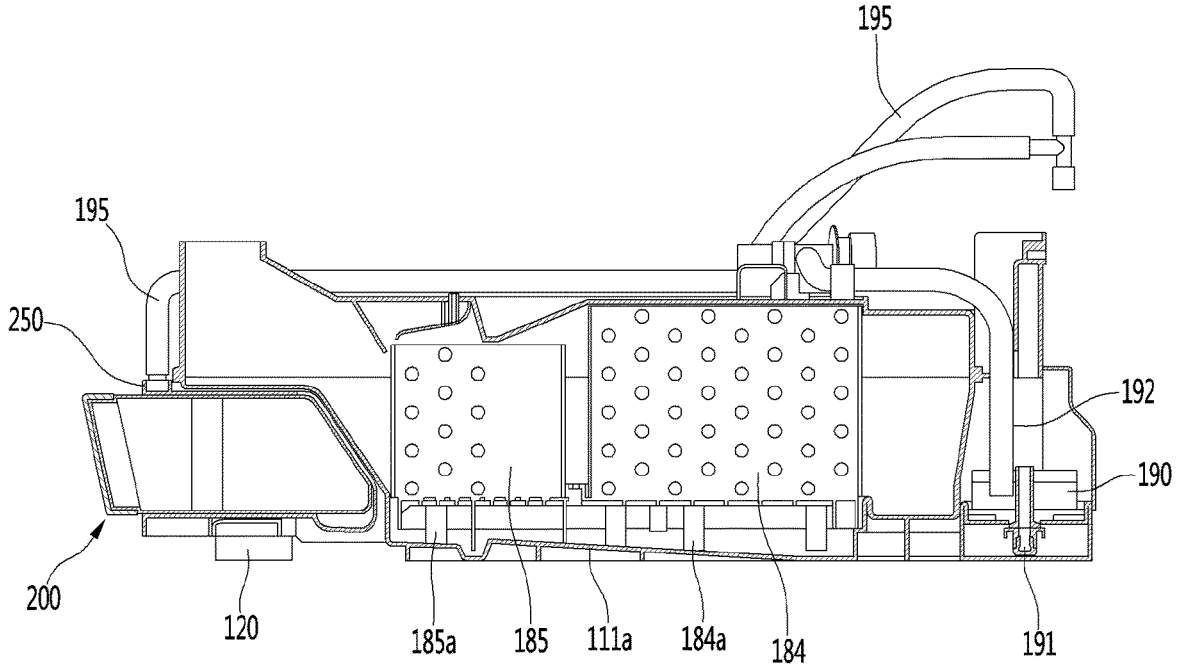
FIG. 5 is a cross-sectional view taken along line V-V' of FIG. 4.

FIG. 4 is a view illustrating a portion of example components disposed in the lower portion of the dryer according to the first implementation, and FIG. 5 is a cross-sectional view taken along line V-V' of FIG. 4.

Referring to FIGS. 4 and 5, a heat pump device for generating drying air and a circulation device generating air circulated through the drum may be disposed in the lower portion of the dryer 10.

The heat pump device may include a compressor 181, a condenser 194, an expansion device, and an evaporator 185.

The compressor 181 may be installed on the top surface of the base panel 111 to suction a gaseous refrigerant separated from a gas/liquid separator 182. The gas/liquid separator 182 may be coupled to a side portion of the compressor 181.

The condenser 184 and the evaporator 185 may be installed on the top surface of the base panel 111, and the condenser 184 may be disposed at an outlet-side of the evaporator 185 with respect to an air flow. A condenser support part 184*a* supporting the condenser 184 may be disposed below the condenser 184, and an evaporator support part 185*a* supporting the evaporator 185 may be disposed below the evaporator 185. The condenser support part 184*a* and the evaporator support part 185*a* may protrude upward from the base panel 111.

Also, a cover member 175 is disposed above the condenser 184 and the evaporator 185. An air passage may be defined in the base panel 111 and the cover member 175, and the condenser 184 and the evaporator 185 may be disposed on the air passage.

Wet air discharged from the drum may be condensed while passing through the evaporator 185 to generate condensate water. The generated condensate water may drop to be collected into a condensate water tray 111*a* disposed below the evaporator 185. The condensate water tray 111*a* may be integrated with the base panel 111 or may be provided as a separate member and then seated on the base panel 111.

Also, the condensate water tray 111*a* may extend to a pump 190 disposed on a rear portion of the base panel 111. For example, the condensate water tray 111*a* may be inclined downward toward a rear side to guide the condensate water so that the condensate water is collected toward the pump 190.

The condenser 184 may be disposed at an outlet-side of the evaporator 185 (e.g., a rear side of the evaporator 185). The condenser 184 may perform a function of heating the drying air passing through the evaporator 185.

The circulation device includes a fan that causes air flow, and a plurality of ducts that are configured to guide the flow of the circulating air. For example, the fan may be configured to introduce air from a suction side toward a discharge-side. The ducts may include an inflow duct 160 disposed at the suction-side of the fan 170, and a discharge duct 165 disposed at the discharge-side of the fan 170.

The inflow duct 160 may be disposed at an inlet-side of the evaporator 185. The inflow duct 160 includes a duct inflow part 161 through which the air passing through the drum is introduced and a duct discharge part 163 guiding the air to the heat pump device. The air may flow to the evaporator 185 of the heat pump device via the duct inflow part 161 and the duct discharge part 163.

The fan 170 is disposed at an outlet-side of the condenser 184, and the air heated in the condenser 184 passes through the discharge duct 165 via the fan 170. Also, the air passing through the discharge duct 165 may be introduced into the drum.

A pump 190 for pumping the collected condensate water (the water) may be disposed at the rear portion of the base panel 111. The condensate water tray 111*a* may extend backward from a lower side of the evaporator 185 up to a lower side of the pump 190 via a lower side of the condenser 184.

The pump 190 may include a pump inflow part 191 and a pump discharge part 192. The pump inflow part 191 may communicate with the water collected in the condensate water tray 111*a* so that the water is introduced into the pump 190. Also, the pump discharge part 192 guides the water pumped by the pump 190 upward. The pump inflow part 191 may be connected to a lower portion of the pump 190, and the pump discharge part 192 may be connected to an upper portion of the pump 190.

The dryer 10 further includes a condensate water tube 195 guiding the water pumped by the pump 190 to the water tank 200. The condensate water tube 195 may be connected to the pump discharge part 192 to extend forward toward the water tank 200.

The condensate water tube 195 may be supported on the cover member 175. A clip 176 for fixing the condensate water tube 195 is disposed on a top surface of the cover member 175.

The dryer 10 further includes a water tank case 250 into which the water tank 200 is inserted. The water tank case 250 may have a hexagonal shape with a front side opened to surround the water tank 200. The water tank case 250 may make up the front portion of the base panel 111. The water tank case 250 may be integrated with the base panel 111 or be provided as a separate member and then coupled to the base panel 111.

The water tank case 250 includes a tube coupling part 255 coupled to the condensate water tube 195. The tube coupling part 255 may be defined in a top surface of the water tank case 250 and have a hole shape. The top surface of the water tank case 250 may be disposed adjacent to a water tank inflow part 235 of the water tank 200 or the cap 300. Also, the tube coupling part 255 and the cap 300 may be aligned in the vertical direction. Thus, the condensate water flowing through the condensate water tube 195 may drop downward via the tube coupling part 255 of the water tank case 250.

The dropping condensate water may be introduced into the water tank 200 through the water tank inflow part 235 of the water tank 200. Here, the cap 300 coupled to the water tank inflow part 235 may be opened. Hereinafter, one or more components and operation of the cap 300 will be described with reference to the accompanying drawings.

Figure 6:
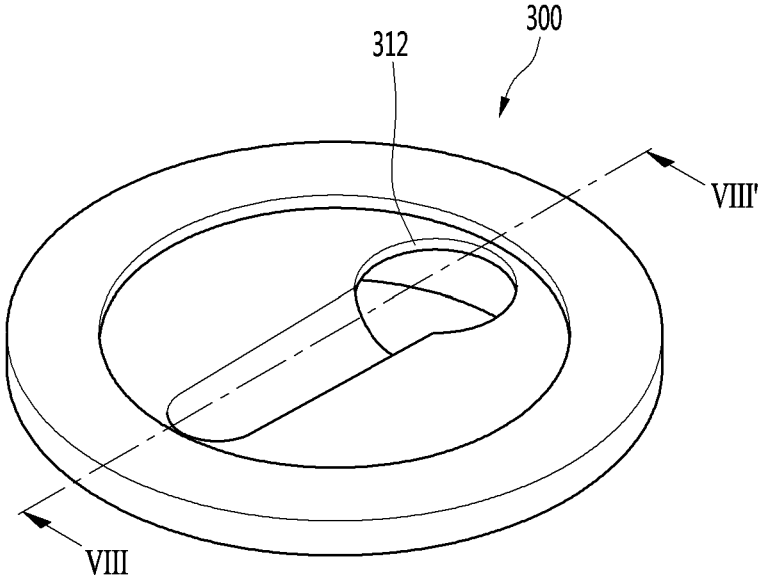
FIG. 6 is a perspective view illustrating an example cap.
Figure 7:
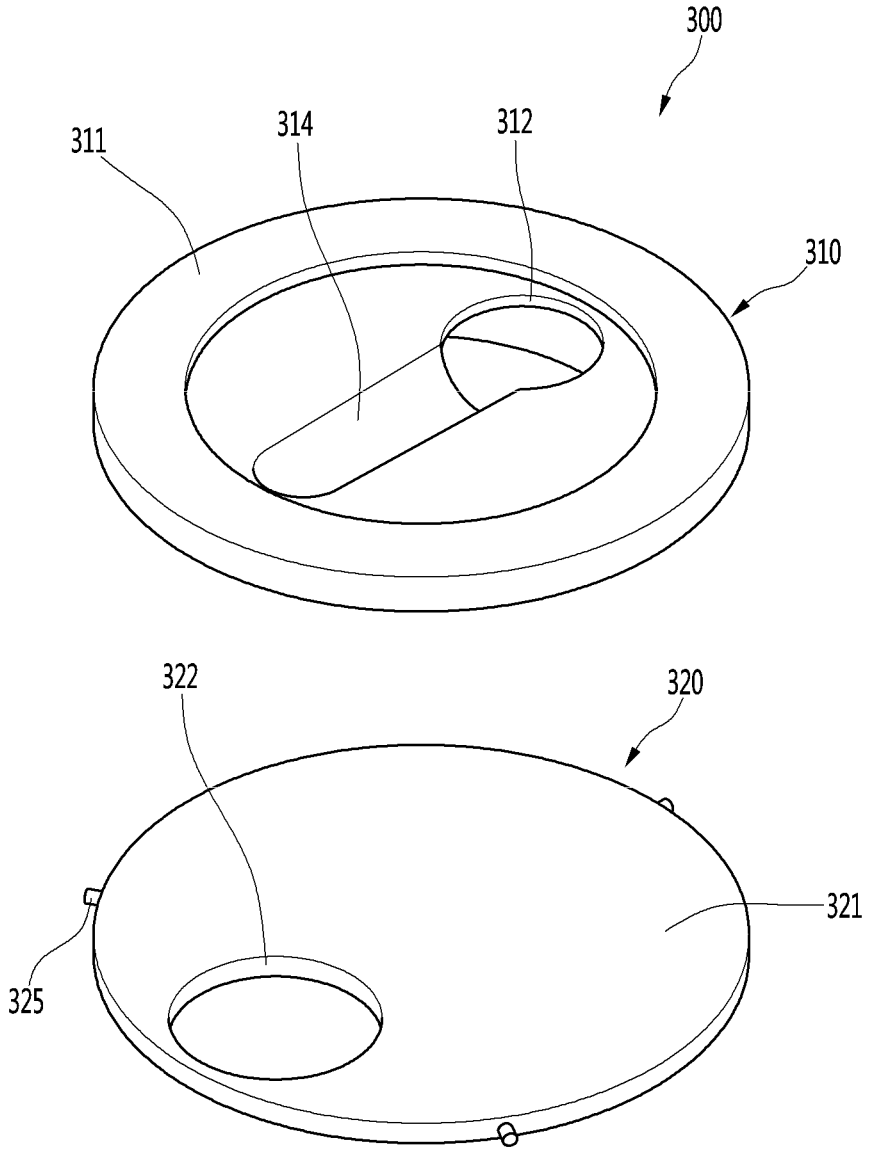
FIG. 7 is an exploded perspective view illustrating the cap.
Figure 8:
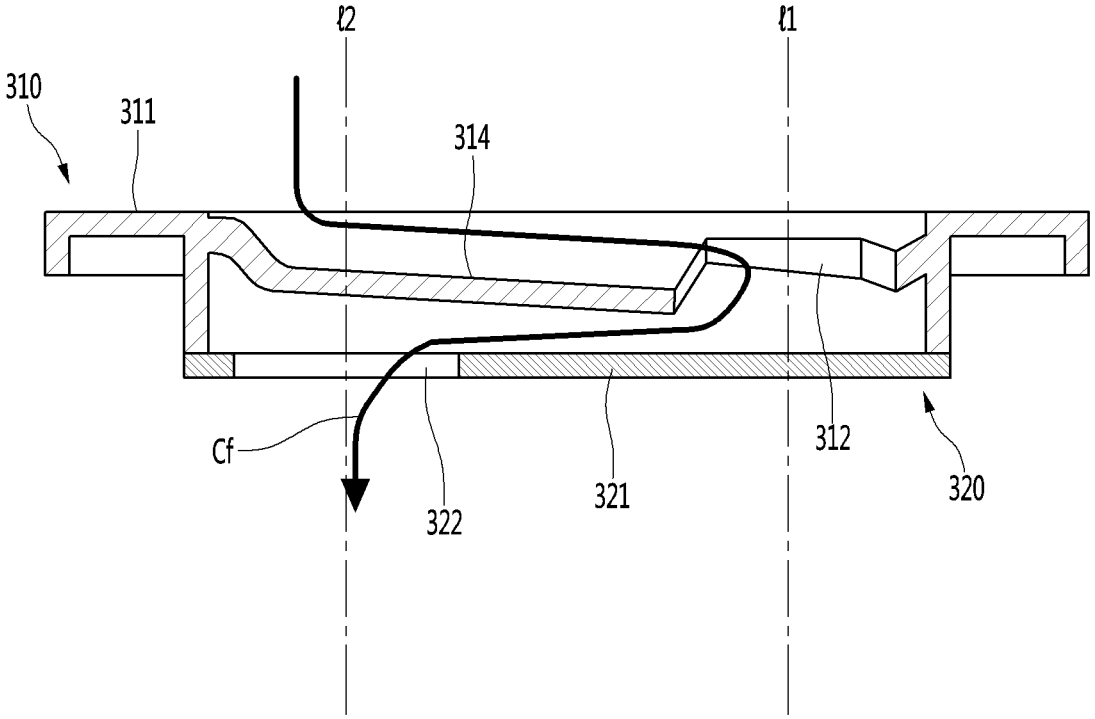
FIG. 8 is a cross-sectional view taken along line VIII-VIII' of FIG. 6.

FIG. 6 is a perspective view illustrating an example configuration of the cap according to the first implementation, FIG. 7 is an exploded perspective view illustrating an example configuration of the cap according to the first implementation, and FIG. 8 is a cross-sectional view taken along line VIII-VIII' of FIG. 6.

Referring to FIGS. 6 to 8, the cap 300 according to the first implementation may be coupled to the water tank inflow part 235 of the water tank 200. In detail, the cap 300 includes a first cap member 310 and a second cap member 320 coupled to a lower portion of the first cap member 310. Each of the first and second cap members 310 and 320 may have a disk shape.

The first cap member 310 includes a first body part 311 having a circular shape and a recess part 314 that is recessed downward from a top surface of the first body part 311. The recess part 314 may be disposed below the tube coupling part 255 of the water tank case 250 and define a passage through which the dropping condensate water flows through the tube coupling part 255. The recess part 314 may lengthily extend in a radial direction of the first body part 311.

The first cap member 310 has a first hole 312 guiding the condensate water to a lower side of the first cap member 310. The first hole 312 may be defined in an end portion of the recess part 314. The condensate water flowing along the recess part 314 may drop from the first hole 312 toward the second cap member 320.

To allow the condensate water to easily drop through the first hole 312, the recess part 314 may be inclined downward toward the first hole 312.

The second cap member 320 includes a second body part 321 having a circular shape and a second hole 322 passing through the second body part 321. The second hole 322 may guide the condensate water to a lower side of the cap 300 so that the condensate water is collected into the water tank 200.

The second hole 322 may be defined below the recess part 314. In detail, the recess part 413 may extend backward toward the first hole 312, and the second hole 322 may be defined below a front portion of the recess part 314.

In more detail, when a first extension line l1 longitudinally crossing a center of the first hole 312 and a second extension line l2 longitudinally crossing a center of the second hole 322 are defined, the first extension line l1 and the second extension line l2 may be spaced forward and backward from each other. For instance, the center of the first hole 312 may be offset from the center of the second hole 322. In some cases, the first hole 312 and the second hole 322 may partially overlap with each other. In other cases, the first hole 312 and the second hole 322 may be spaced apart from each other without overlapping.

Due to the above-described configuration, the passage defined in the cap 300 may be bent at least one or more times in an opposite direction. For example, the condensate water may flow backward along the recess part 314 to drop into the first hole 312, and then may flow forward along the top surface of the second body part 321. Then, the condensate water may be discharged downward from the second hole 322 (Cf).

As a result, the water passage in the cap 300 may be slightly complicated to be bent to prevent the water stored in the water tank 200 from overflowing to the outside through the cap 300 even though the water tank 200 is shaken.

Figure 9A:
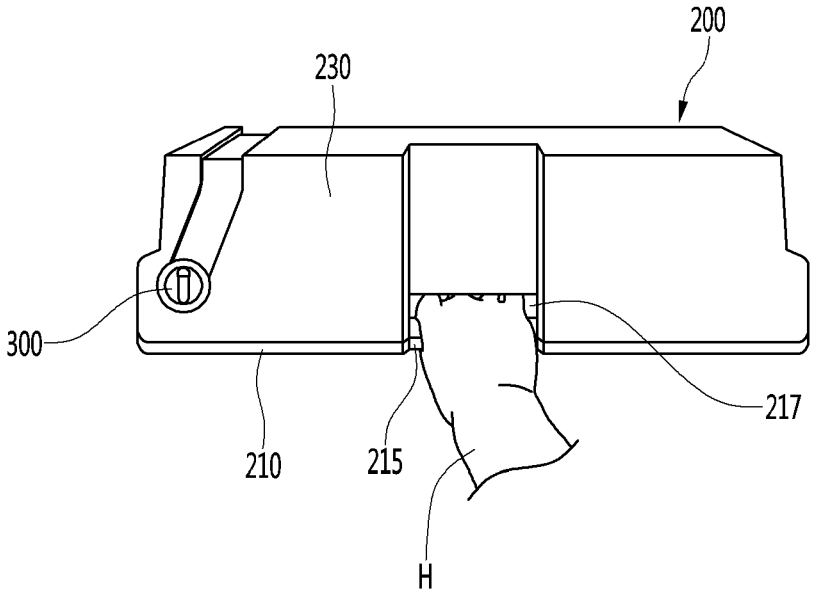
FIG. 9A is a view illustrating an example state in which the water tank is grasped by a user.
Figure 9B:
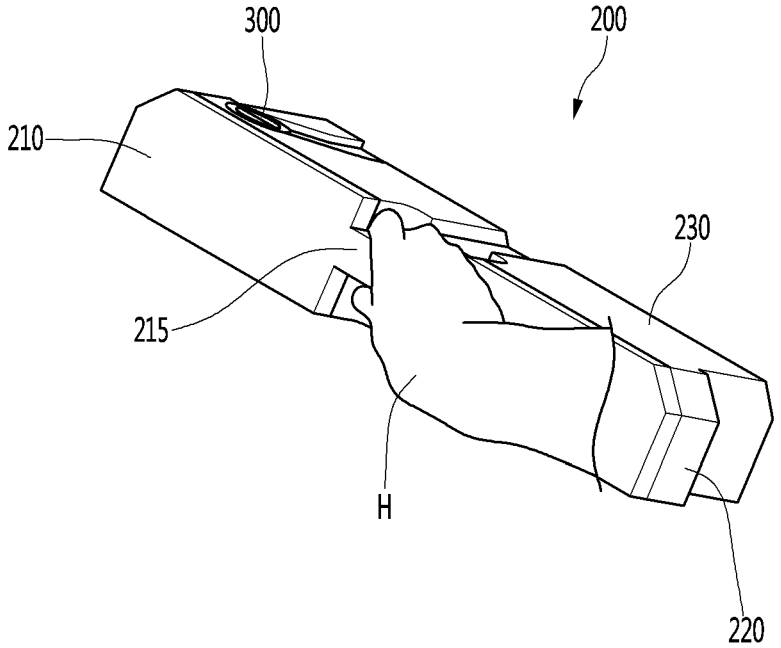
FIG. 9B is a view illustrating an example state in which the water tank is grasped by the user and carried in a vertical direction.

FIG. 9A is a view illustrating an example state in which the water tank is grasped by a user according to the first implementation, and FIG. 9B is a view illustrating an example state in which the water tank is grasped by the user and oriented in the vertical direction according to the first implementation.

FIG. 9A illustrates an example state in which the user manipulates the water tank 200. For example, the user may grasp the handle 215 by his/her hand H and take out the water tank forward from the dryer 10. FIG. 9B illustrates an example state in which the user lifts the water tank 200.

As described above, the handle 215 of the water tank 200 may be disposed on the front surface part 210 of the water tank 200, and the water tank inflow part 235 may be disposed on the top surface part 230 of the water tank 200. Thus, when the user grasps and lift the water tank 200, the water tank inflow part 235 may be disposed on a side surface of the water tank 200.

If the cap 300 is not provided on the water tank inflow part 235, the water stored in the water tank 200 may be discharged to the outside. However, according to this implementation, the cap 300 may be disposed on the water tank inflow part 235, and the passage bent in the cap 300 may prevent the water from being discharged to the outside.

As described above, the condensate water may flow along the passage within the cap 300 and then be introduced into the water tank 200 while the water is collected into the water tank 200. In some examples, the water within the water tank 200 may be prevented from being discharged to the outside of the water tank 200 through the passage within the cap 300.

Hereinafter, additional other implementations will be described. The additional implementations are different from the foregoing implementation in that the cap has a different structure to prevent the water from overflowing from the water tank 200. Thus, it should be noted in advance that the configurations of the dryer 10 and the water tank 200 described in the first implementation except for a cap may be similarly applied to these additional implementations. Also, the description of the first implementation and the reference numerals are used for the same parts as those of the first implementation.

Figure 10:
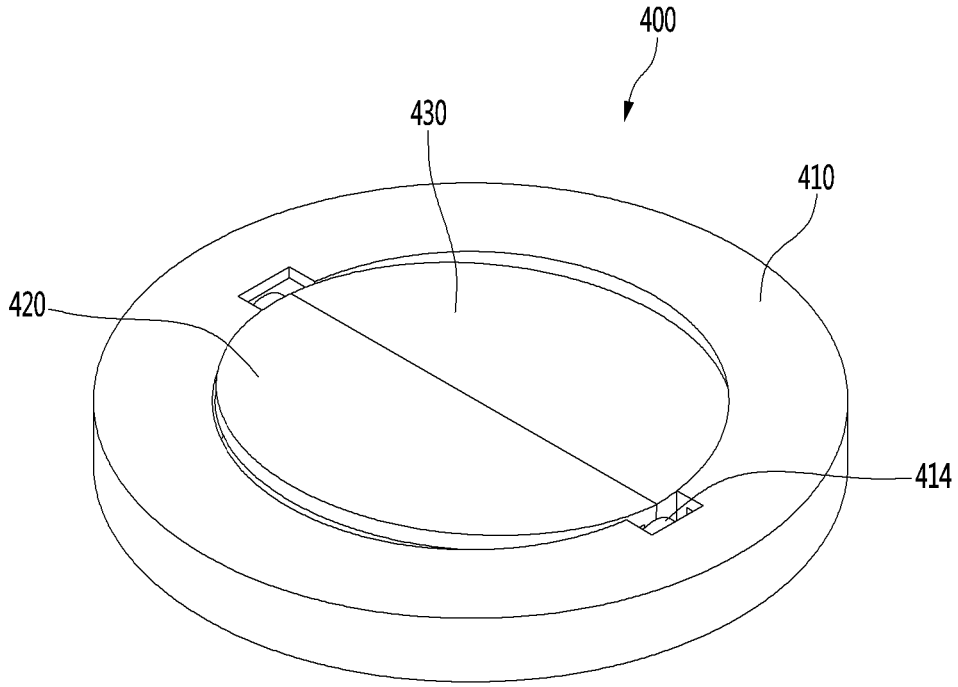
FIG. 10 is a perspective view illustrating another example cap.
Figure 11:
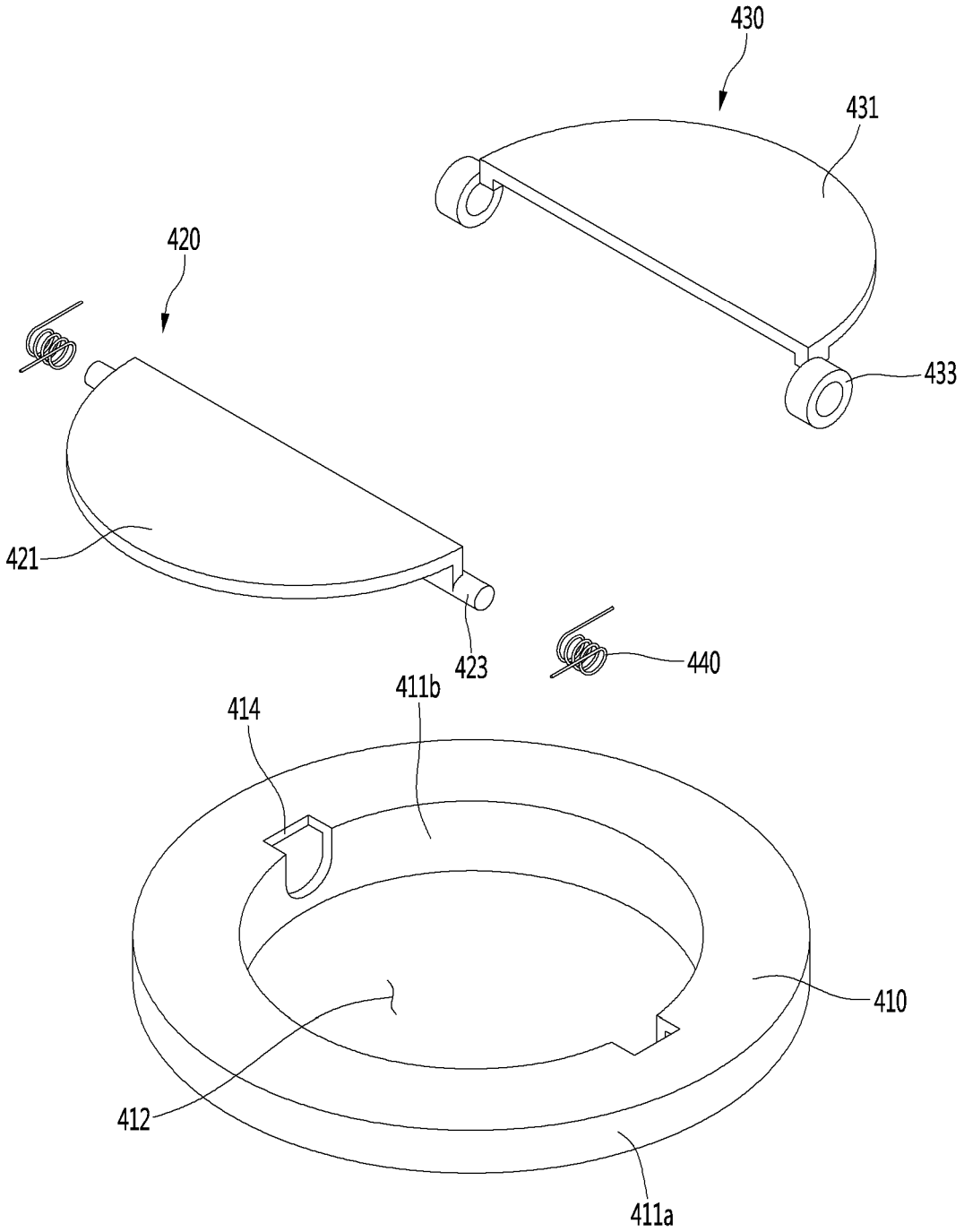
FIG. 11 is an exploded perspective view illustrating the cap of FIG. 10.
Figure 12:
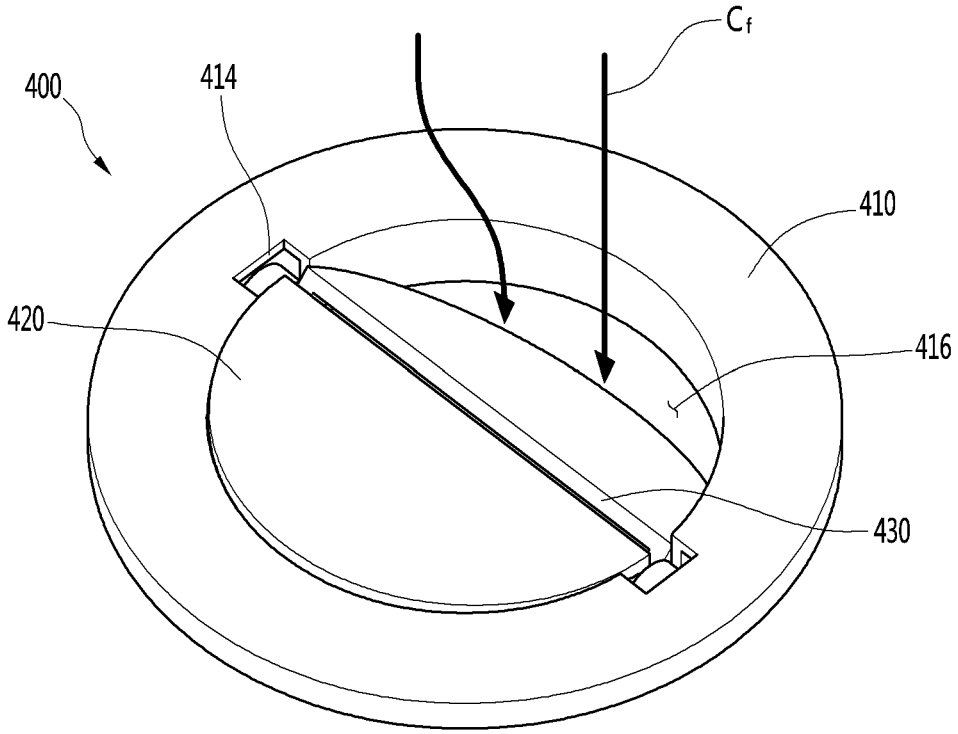
FIG. 12 is a view illustrating an example state in which condensate water flows through the cap of FIG. 10.

FIG. 10 is a perspective view illustrating a configuration of an example cap according to a second implementation, FIG. 11 is an exploded perspective view illustrating the configuration of the cap according to the second implementation, and FIG. 12 is a view illustrating an example state in which condensate water flows through the cap according to the second implementation.

Referring to FIGS. 10 to 12, a cap 400 according to a second implementation may be coupled to a water tank inflow part 235 of a water tank 200. In detail, the cap 400 includes a cap body 410 having a ring shape, a fixed member 420 coupled to the cap body 410, and a closing member 430 rotatably disposed at one side of the fixed member 420.

The cap body 410 may have an outer circumferential part 411*a* and an inner circumferential part 411*b*. An installation space part 412 in which the fixed member 420 and the closing member 430 are installed may be defined inside the inner circumferential part 411*b*. The installation space part 412 may have a circular shape and called a "condensate water hole" in that condensate water drops downward. The fixed member 420 may cover at least a portion of the installation space part 412, and the closing member 430 may cover the remaining portion of the installation space part 412.

The cap body 410 includes a hinge hole 414 supporting the fixed member 420 and the closing member 430. The hinge hole 414 may be defined in each of both sides of the inner circumferential part 411*b* of the cap body 410. A hinge protrusion 423 of the fixed member 420 and a protrusion coupling part 433 of the closing member 430 may be inserted into the hinge hole 414.

The fixed member includes a first body having a half disk shape and a hinge protrusion 423 protruding from each of both sides of the first body 421. The first body 421 may be fixed to the inner circumferential part 411*b* of the cap body 410. For example, the first body 421 may adhere to the inner circumferential part 411*b* of the cap body 410.

A spring 440 providing restoring force to the closing member 430 may be disposed on the hinge protrusion 423. The spring 440 includes a torsion spring coupled to an outer circumferential surface of the hinge protrusion 423.

The closing member 430 includes a second body 431 having a half disk shape and a protrusion coupling part 433 which is disposed on each of both sides of the second body 431 and into which the hinge protrusion 423 is inserted. The protrusion coupling part 433 has a hollow cylindrical shape, and the hinge protrusion 423 and the spring 440 may be inserted into the protrusion coupling part 433.

Since each of the first body 421 and the second body 431 has the half disk shape, the fixed member 420 and the closing member 430 may be easily disposed in the circular installation space part 412.

The closing member 430 may be rotatable downward with respect to the protrusion coupling part 433. When the condensate water acts on a top surface of the closing member 430, the closing member 430 may overcome elastic force of the spring 440 to rotate downward. Also, the installation space part 412 may be opened as the closing member 430 rotates downward, and the condensate water may drop downward along the opened space (Cf).

When the force of the condensate water, which acts on the closing member 430, is stopped, the closing member 430 may rotate upward by the restoring force of the spring 440 to close the installation space part 412. That is, a space part having a semicircular shape, in which the closing member 430 is disposed, in the installation space part 412 may define a condensate water hole that is opened and closed to allow the condensate water to be introduced into the water tank 200.

As described above, while the condensate water is collected into the water tank 200, when the condensate water acts on the cap 400, the closing member 430 may be opened to collect the condensate water into the water tank 200. For example, the condensate water may apply its weight on the cap 400. When the acting of the condensate water is stopped, the closing member 430 may be closed to prevent the water from being discharged from the water tank 200 even though the user manipulates the water tank 200.

Figure 13:
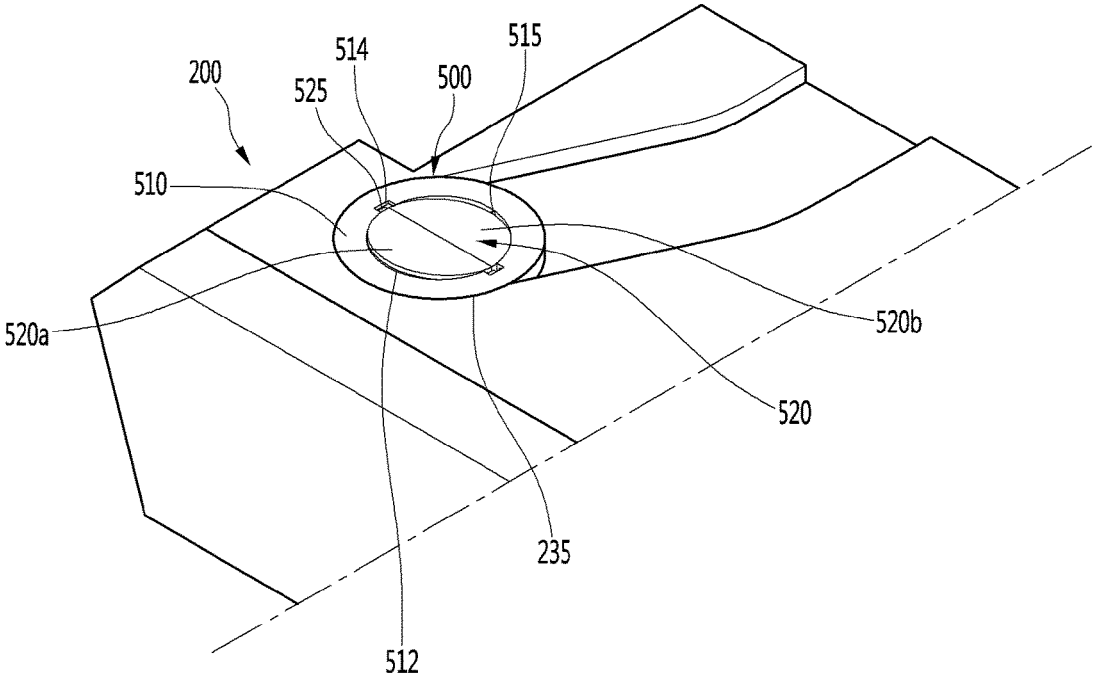
FIG. 13 is a view illustrating an example state in which another example cap is coupled to a water tank.

FIG. 13 is a view illustrating an example state in which an example cap is coupled to an example water tank according to a third implementation.

Referring to FIG. 13, a cap 500 according to a third implementation may be coupled to a water tank inflow part 235 of a water tank 200. In detail, the cap 500 includes a cap body 510 having a ring shape and a closing member 520 rotatably coupled to the cap body 510.

An installation space part 512 in which the closing member 520 is installed may be defined in an inner space of an inner circumferential surface of the cap body 510. The installation space part 512 may be called a "condensate water hole" in that condensate water is introduced into a water tank 200 therethrough.

A hinge part 514 supporting the closing member 520 is disposed on the inner circumferential surface of the cap body 510. The hinge part 514 may be coupled to a hinge protrusion 525 of the closing member 520. The closing member 520 may vertically rotate with respect to a center of the hinge protrusion 525.

In some implementations, a stopper 515 preventing a second part 520*b* of the closing member 520 from rotating to the outside of a water tank inflow part 235 with respect to the cap body 510 may be disposed on the inner circumferential surface of the cap body 510. The second part 520*b* may rotate to only the inside of the water tank inflow part 235 by the stopper 515.

In some implementations, the closing member 520 may include a plurality of parts. For example, the closing member 520 may include two parts 520*a* and 520*b* that define a disk shape, and one or both of the two parts 520*a* and 520*b* may have an eccentric weight distribution. For example, each of the two parts 520*a* and 520*b* may have a half disk shape. In some cases, each of the two parts 520*a* and 520*b* may have an eccentric weight distribution, where a center of mass of each part is offset toward a side of the part. For instance, the center of mass of each of the two parts 520*a* and 520*b* is disposed at a position closer to a center for the cap body 510 than an inner circumference of the cap body 510. In some cases, a portion of each of the two parts 520*a* and 520*b* defines an empty space, which may result in an eccentric weight distribution of the part. The stopper 515 may protrude from the inner circumferential surface of the cap body 510 at a position corresponding to a portion at which the second part 520*b* is disposed.

The two parts 520*a* and 520*b* include a first part 520*a* having a relatively heavy weight and the second part 520*b* integrated with the first part 520*a* and having a weight less than that of the first part 520*a*.

Also, the closing member 520 further include a hinge protrusion 525 protruding from an outer circumferential surface of the closing member 520 to each of both sides. The closing member 520 may vertically rotate with respect to the hinge protrusion 525.

When the condensate water does not act on the closing member 520, the first part 520*a* may move to the inside of the water tank inflow part 235 by a self-weight thereof, and the second part 520*b* may be supported on the stopper 515. As a result, the closing member 520 may close the installation space part 512 of the cap body 510.

When the condensate water acts on the closing member 520, the second part 520*b* may rotate downward with respect to the hinge protrusion 525 to open the installation space part 512. Also, the condensate water may be introduced into the water tank 200 through the installation space part 512. In some cases, when the condensate water acts on the first part 520*a*, the first part 520*a* may rotate downward until the second part 520*b* is supported on the stopper 515, and stop rotating downward after the second part 520*b* is supported on the stopper 515.

Due to this configuration, while the condensate water is collected into the water tank 200, when the condensate water acts on the cap 500, the closing member 520 may be opened to collect the condensate water into the water tank 200. When the acting of the condensate water is stopped, the closing member 520 may be closed to prevent the water from being discharged from the water tank 200 when the user manipulates the water tank 200.

Figure 14:
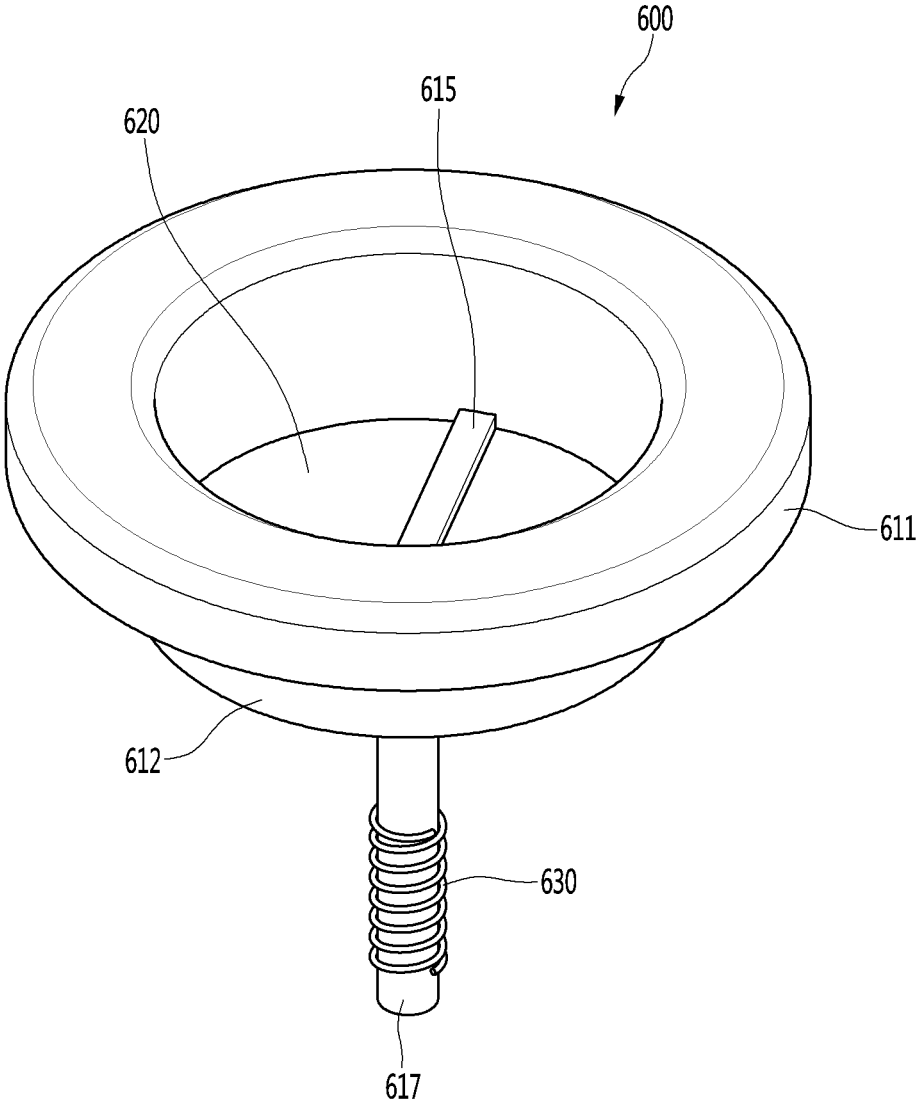
FIG. 14 is a perspective view illustrating another example cap.
Figure 15:
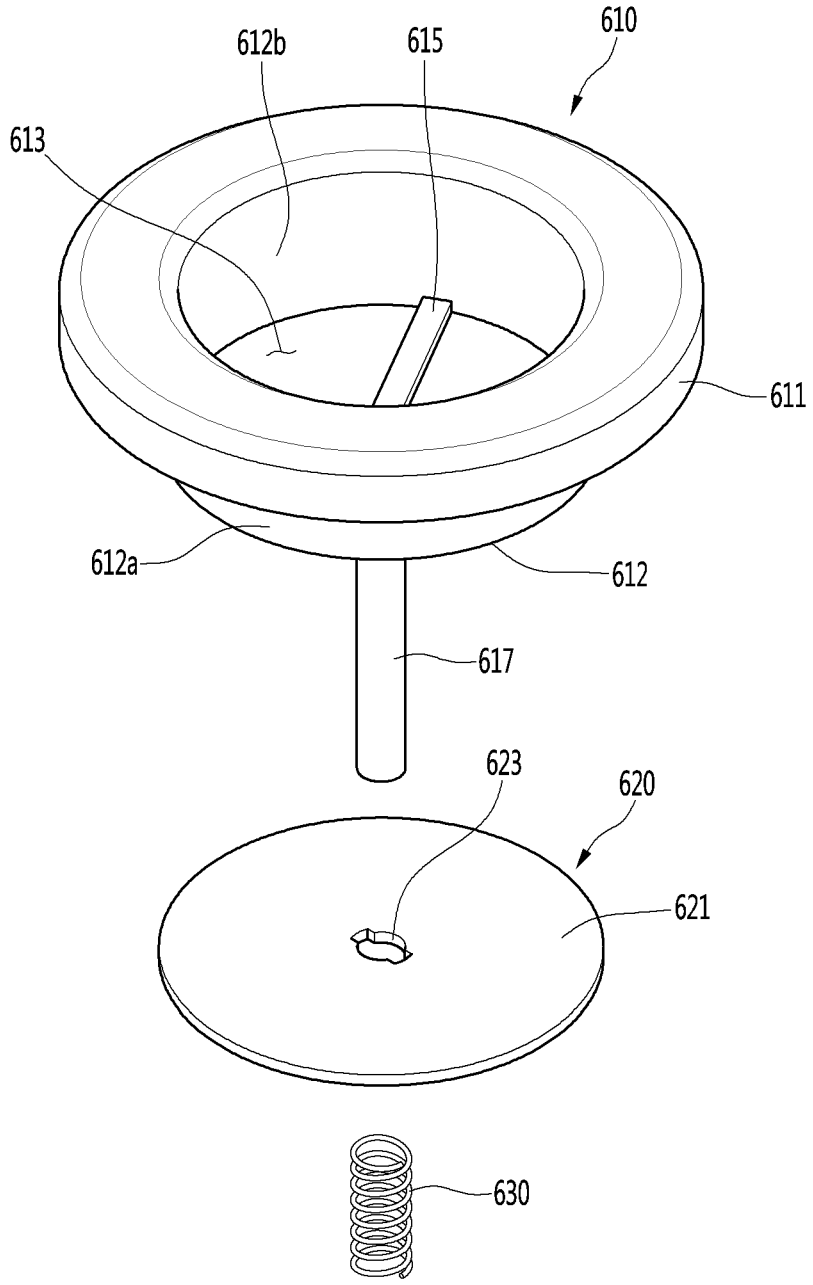
FIG. 15 is an exploded perspective view illustrating the cap of FIG. 14.
Figure 16:
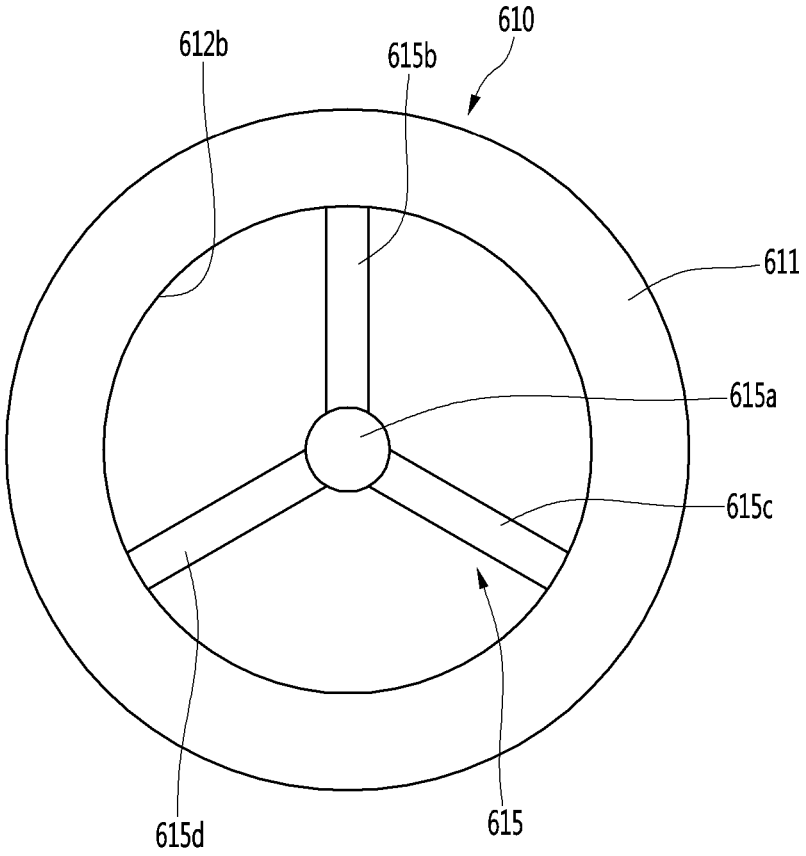
FIG. 16 is a plan view illustrating an example cap body of the cap of FIG. 14.
Figure 17:
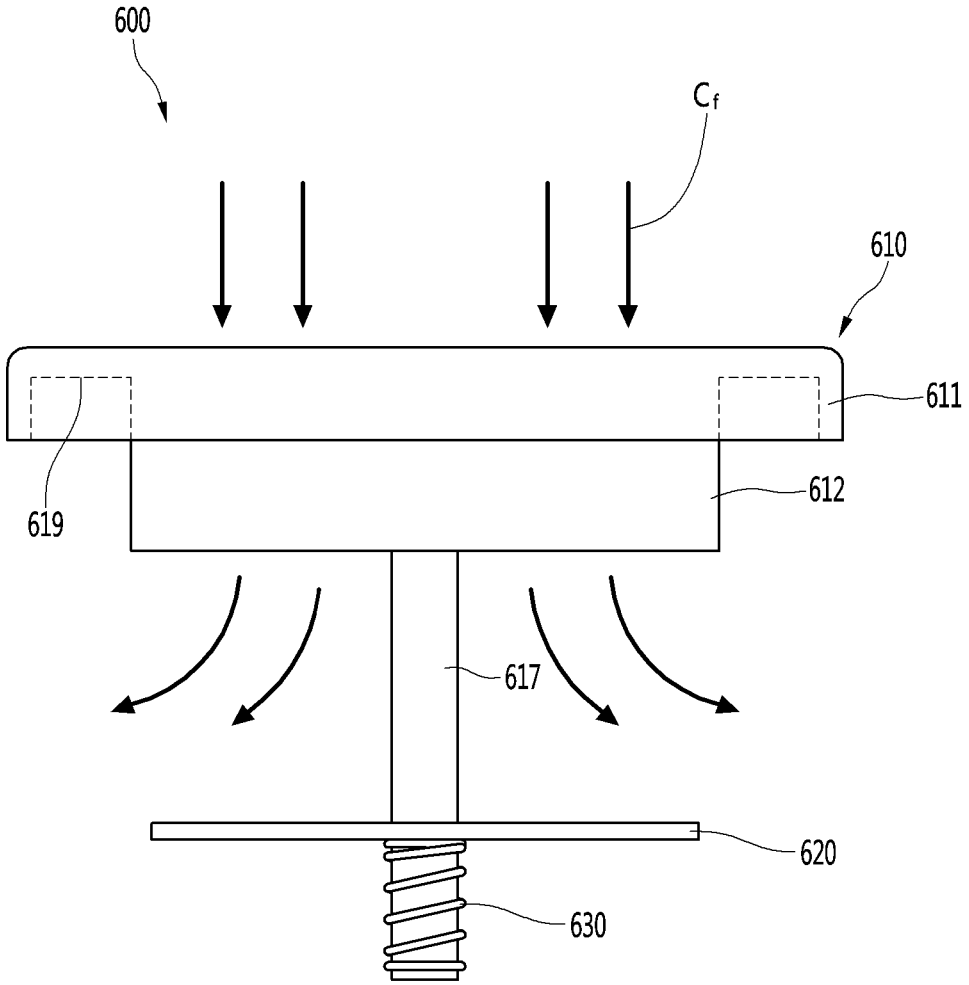
FIG. 17 is a view illustrating an example state in which condensate water flows through the cap of FIG. 14.

FIG. 14 is a perspective view illustrating a configuration of an example cap according to a fourth implementation, FIG. 15 is an exploded perspective view illustrating the configuration of the cap according to the fourth implementation, FIG. 16 is a plan view illustrating a configuration of an example cap body of the cap according to the fourth implementation, and FIG. 17 is a view illustrating an example state in which condensate water flows through the cap according to the fourth implementation.

Referring to FIGS. 14 to 17, a cap 600 according to a fourth implementation may be coupled to a water tank inflow part 235 of a water tank 200. In detail, the cap 600 includes a cap body 610, a closing member 620 movably coupled to the cap body 610, and a spring 630 elastically supporting the closing member 620.

The cap body 610 includes a first body 611 coupled to the water tank inflow part 235, and a second body 612 that extends downward from the first body 611 and that includes a moving guide 617 configured to guide a vertical movement of the closing member 620. For example, the first body 611 may extend radially outward of the second body 612, and may be configured to couple to the top surface part of the water tank. The second body 612 may extend downward from the first body 611, and may be configured to be inserted to the water tank inflow part 235.

The first body 611 has an eaves shape. For example, an upper portion of the first body 611 may protrude radially outward of a lower portion of the first body 611. In some implementations, an inflow coupling part 619 having a bent shape and coupled to the water tank inflow part 235 is disposed on a bottom surface of the first body 611. The inflow coupling part 619 may be disposed to surround the water tank inflow part 235.

The second body 612 may have a hollow cylindrical shape with an upper portion that is open and a lower portion configured to be inserted into the water tank inflow part 235. In detail, the second body 612 includes an outer circumferential part 612*a* and an inner circumferential part 612*b*. A condensate water hole 613 through which the condensate water flows may be defined inside the inner circumferential part 612*b*.

The cap 600 includes a support leg 615 coupled to the inner circumferential part 612*b* of the second body 612. The support leg 615 includes a leg central portion 615*a* disposed at a center of the condensate water hole 613 and a plurality of legs 615*b*, 615*c*, and 615*d* extending radially from the leg central portion 615*a*.

For example, the plurality of legs 615*b*, 615*c*, and 615*d* include a first leg 615*b*, a second leg 615*c*, and a third leg 615*d*. The first to third legs 615*b*, 615*c*, and 615*d* may be coupled to the inner circumferential part 612*b*. However, the number of legs is not limited thereto.

The plurality of legs 615*b*, 615*c*, and 615*d* may serve as stoppers that limit vertical movement of the closing member 620. The ascending of the closing member 620 toward the inside of the condensate water hole 613 may be limited by the plurality of legs 615*b*, 615*c*, and 615*d*.

The cap 600 further includes a moving guide 617 extending downward from the leg central portion 615*a*. For example, the moving guide 617 may have a thin cylindrical shape that extends in the vertical direction. The moving guide 617 may be supported on the second body 612 by the support leg 615.

The closing member 620 may have a disk shape and open and close the condensate water hole 613. In detail, the closing member 620 includes a closing body 621 having a disk shape and a through-hole 623 defined to pass through the closing body 621. The through-hole 623 may be formed in a central portion of the closing body 621. The moving guide 617 may be inserted into the through-hole 623, and the closing member 620 may vertically move along the moving guide 617.

The spring 630 may be coupled to a lower portion of the moving guide 617 and disposed below the closing member 620. For example, the spring 630 may include a coil spring and a compressive spring.

When the condensate water does not act on the closing member 620, the closing member 620 may move upward by restoring force of the spring 630 to close the condensate water hole 613. Here, a top surface of the closing member 620 may contact the support leg 615, and the spring 630 may be in a tensioned state.

In some examples, when the condensate water acts on the closing member 620, the closing member 620 may overcome the restoring force of the spring 630 to move downward by a weight of the condensate water. Here, the spring 630 may be in a compressed state. When the closing member 620 moves downward, the condensate water hole 613 may be opened so that the condensate water drops through the opened condensate water hole 613 and then is introduced into the water tank 200 (Cf).

Due to this configuration, while the condensate water is collected into the water tank 200, when the condensate water acts on the cap 600, the closing member 620 may be opened to collect the condensate water into the water tank 200. When the acting of the condensate water is stopped, the closing member 620 may be closed to prevent the water from being discharged from the water tank 200 even though the user manipulates the water tank 200.

Figure 18:
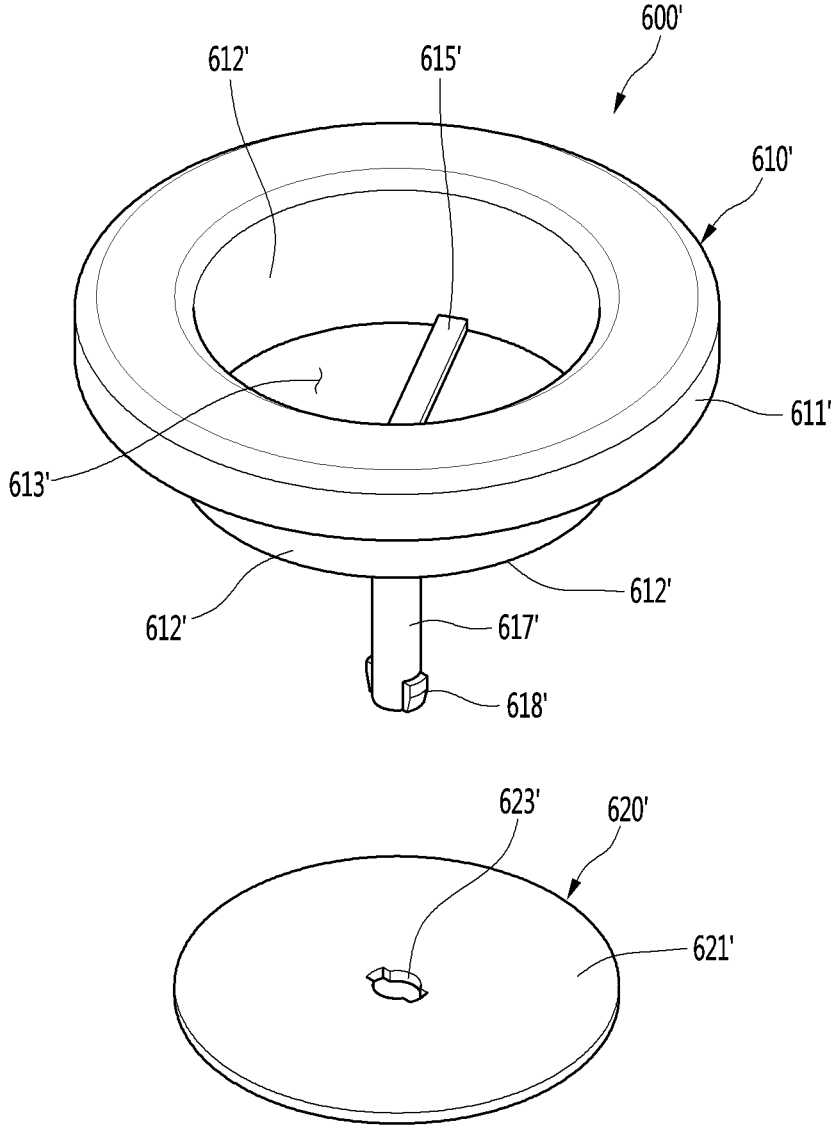
FIG. 18 is an exploded perspective view illustrating another example cap.
Figure 19:
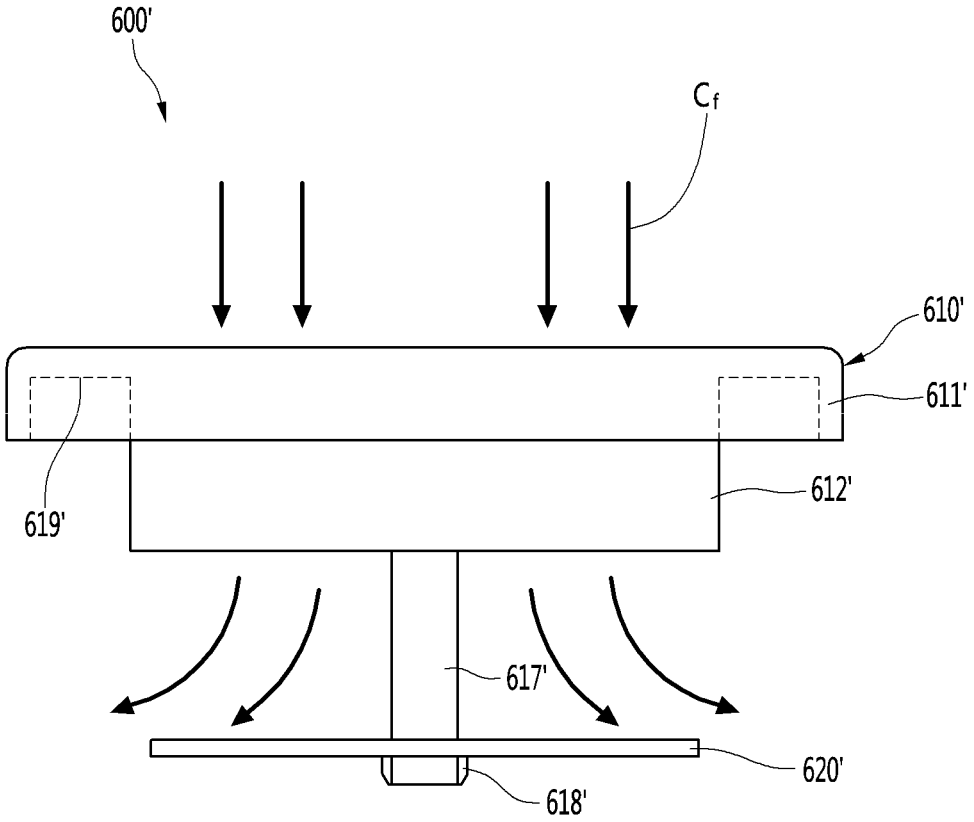
FIG. 19 is a view illustrating an example state in which condensate water flows through the cap of FIG. 18.

FIG. 18 is an exploded perspective view illustrating a configuration of an example cap according to a fifth implementation, and FIG. 19 is a view illustrating an example state in which condensate water flows through the cap according to the fifth implementation.

Referring to FIGS. 18 and 19, a cap 600' according to a fifth implementation may be coupled to a water tank inflow part 235 of a water tank 200. In detail, the cap 600' includes a cap body 610' and a closing member 620' rotatably coupled to the cap body 610'.

The cap body 610' includes a first body 611' coupled to the water tank inflow part 235 and a second body 612' extending downward from the first body 611' and including a moving guide 617' guiding vertical movement of the closing member 620'.

The first body 611' has an eaves shape. For example, an upper portion of the first body 611' may protrude radially outward of a lower portion of the first body 611'. In some implementations, an inflow coupling part 619' having a bent shape and coupled to the water tank inflow part 235 is disposed on a bottom surface of the first body 611'. The inflow coupling part 619' may be disposed to surround the water tank inflow part 235.

The second body 612' may have a hollow cylindrical shape with upper and lower portion opened and be inserted into the water tank inflow part 235. In detail, the second body 612' includes an outer circumferential part 612*a'* and an inner circumferential part 612*b'*. A condensate water hole 613' through which the condensate water flows may be defined inside the inner circumferential part 612*b'*.

The cap 600' includes a support leg 615' coupled to the inner circumferential part 612*b'* of the second body 612'. The description with respect to the support leg 615' may be derived from those according to the fourth implementation.

The cap 600' further includes a moving guide 617' extending downward from the leg central portion 615*a* '. For example, the moving guide 617' may have a thin cylindrical shape that extends in the vertical direction. The moving guide 617' may be supported on the second body 612' by the support leg 615'.

A stopper 618' limiting the downward movement of the closing member 620' may be disposed on the moving guide 617'. The stopper 618' may be disposed to protrude from an outer circumferential surface of a lower portion of the moving guide 617'. The stopper 618' may interfere with a bottom surface of the closing member 620'.

The closing member 620' may have a disk shape and open and close the condensate water hole 613'. In detail, the closing member 620' includes a closing body 621' having a disk shape and a through-hole 623' defined to pass through the closing body 621'. The description with respect to the closing member 620' may be derived from those according to the fourth implementation.

The closing member 620' may vertically move between the support leg 615' and the stopper 618'. That is, the closing member 620' may move upward until the closing member 620' interferes with the support leg 615' (when disposed at an upper side) and move downward until the closing member 620' is supported on the stopper 618' (when disposed at a lower side).

When the condensate water acts on the closing member 620', i.e., when the water tank 200 is mounted on the dryer 10, the closing member 620' may be disposed at a lower position at which the closing member 620' is supported on the stopper 618'. Thus, the condensate water hole 613' may be opened so that the condensate water drops through the opened condensate water hole 613' and then is introduced into the water tank 200 (Cf).

In some examples, when the water tank 200 is separated from the dryer 10, and the user manipulates the water tank 200 so that the water tank 200 is turned upside down or shaken, the closing member 620' may move toward the support leg 615' to close the condensate water hole 613'.

Due to this configuration, while the condensate water is collected into the water tank 200, when the condensate water acts on the cap 600', the closing member 620' may be opened to collect the condensate water into the water tank 200. Also, while the water tank 200 is separated and manipulated by the user, if overflowing of the water to the outside occurs, the closing member 620' may be smoothly closed to prevent the water from being discharged from the water tank 200.

In some implementations, the water tank may be disposed in the lower portion of the cabinet so that the door of the dryer increases in size, thereby improving the space utilization of the dryer.

In some implementations, the cap may be disposed on the water tank to prevent the water from overflowing when the user separates or couples the water tank from or to the dryer. In some examples, the closing member disposed on the cap may be configured to open based on the water being introduced into the water tank, and the closing member may be configured to, based on the user manipulating the water tank, be closed to improve the use convenience.

In some implementations, the bending of the water passage may occur within the cap, thereby preventing the water within the water tank from overflowing even though the water tank is shaken.

In some implementations, when the condensate water is introduced into the water tank, the closing member may be rotated to be opened, and when the introduction of the condensate water is stopped, the closing member may be closed by the restoring force of the spring, thereby preventing the water within the water tank from overflowing even though the water tank is shaken.

In some implementations, when the condensate water is introduced into the water tank, the closing member may be rotated to be opened, and when the introduction of the condensate water is stopped, the closing member may be closed by the characteristics of the closing member having the eccentric weight, thereby preventing the water within the water tank from overflowing even though the water tank is shaken.

In some implementations, when the condensate water is introduced into the water tank, the closing member may linearly move to be opened, and when the introduction of the condensate water is stopped, the closing member may be closed by the restoring force of the spring, thereby preventing the water within the water tank from overflowing even though the water tank is shaken.

In some implementations, when the condensate water is introduced into the water tank, the closing member may linearly move until the closing member interferes with the stopper, and when the water tank is shaken or turned upside down, the closing member may be closed by the self-weight of the closing member, thereby preventing the water within the water tank from overflowing.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dryer comprising:
a cabinet comprising a front panel;
a door coupled to the front panel;
a base disposed on a lower portion of the cabinet;
a condensate water tray disposed on the base and configured to receive water;
a water tank configured to be withdrawn forward of the front panel and configured to store water received in the condensate water tray; and
a cap configured to couple to the water tank,
wherein the water tank comprises:
a front surface part disposed vertically below the front panel of the cabinet,
a top surface part that extends rearward from an upper portion of the front surface part, the top surface part defining a water tank inlet configured to be coupled to the cap, and
a side surface part that extends rearward from each of both sides of the front surface part, and
wherein the cap comprises:
a closing member that is configured to move relative to the top surface part of the water tank,
a cap body that defines a condensate water hole, and
a fixed member that covers a first portion of the condensate water hole, and
wherein the closing member is configured to cover a second portion of the condensate water hole and to rotate relative to the fixed member.

2. The dryer according to claim 1, further comprising:
a pump disposed at a rear side of the condensate water tray; and
a condensate water tube that is connected to the pump and that extends forward toward the water tank.

3. The dryer according to claim 2, further comprising:
a water tank case that defines a front opening configured to receive the water tank therethrough, the water tank case comprising a tube coupling part that is coupled to the condensate water tube and that is disposed vertically below or above the cap.

4. The dryer according to claim 1, wherein the water tank further comprises a handle disposed at the front surface part.

5. The dryer according to claim 1, wherein a left-right width of the front surface part is greater than a front-rear length of the side surface part, and
wherein a vertical height of the front surface part is less than the front-rear length of the side surface part.

6. The dryer according to claim 1, further comprising:
a fan configured to generate an air flow from a suction-side of the fan toward a discharge-side of the fan;
an evaporator disposed at the suction-side of the fan; and
a condenser disposed at an outlet-side of the evaporator facing the discharge-side of the fan.

7. The dryer according to claim 1, further comprising:
a hinge protrusion that is disposed on each of both sides of the fixed member and that defines a rotational center of the closing member; and
a spring coupled to the hinge protrusion and configured to provide restoring force to the closing member.

8. The dryer according to claim 7, wherein the hinge protrusion comprises a first protrusion disposed on a first side of the fixed member and a second protrusion disposed on a second side of the fixed member, the second side being opposite to the first side, and
wherein the spring comprises a first spring coupled to the first protrusion and a second spring coupled to the second protrusion.

9. The dryer according to claim 7, wherein the spring comprises a torsion spring.

10. The dryer according to claim 7, wherein the fixed member comprises a first body having a half disk shape and fixed to an inner circumferential part of the cap body, and
wherein the closing member comprises a second body having a half disk shape and a protrusion coupling part which is disposed on each of both sides of the second body and into which the hinge protrusion is inserted.

11. The dryer according to claim 7, wherein the cap body has a ring shape.

12. A dryer comprising:
a cabinet comprising a front panel;
a door coupled to the front panel;
a base disposed on a lower portion of the cabinet;
a condensate water tray disposed on the base and configured to receive water;
a water tank configured to be withdrawn forward of the front panel and configured to store water received in the condensate water tray; and
a cap configured to couple to the water tank,
wherein the water tank comprises:
a front surface part disposed vertically below the front panel of the cabinet,
a top surface part that extends rearward from an upper portion of the front surface part, the top surface part defining a water tank inlet configured to be coupled to the cap, and
a side surface part that extends rearward from each of both sides of the front surface part,
wherein the cap comprises:
a closing member that is configured to move relative to the top surface part of the water tank, and
a cap body that defines a condensate water hole, and
wherein the closing member comprises first and second parts, each of the first and second parts having an eccentric weight distribution with a center of mass that is offset toward a side of the corresponding part.

13. The dryer according to claim 12, further comprising a hinge part that supports the closing member, that is disposed at an inner circumferential surface of the cap body, and that is coupled to a hinge protrusion of the closing member.

14. The dryer according to claim 13, wherein the closing member is configured to vertically rotate with respect to a center of the hinge protrusion.

15. The dryer according to claim 12, further comprising a stopper disposed at an inner circumferential surface of the cap body and configured to restrict the second part from rotating to an outside of a water tank inflow part with respect to the cap body.

16. The dryer according to claim 12, wherein the center of mass of each of the first and second parts is disposed at a position closer to a center of the cap body than to an inner circumference of the cap body.

17. The dryer according to claim 12, wherein the first part has a weight greater than a weight of the second part.

18. The dryer according to claim 12, wherein the first and second parts are integrated with each other and define a disk shape.

19. The dryer according to claim 12, wherein the cap body has a ring shape.

* * * * *